US005726675A

United States Patent [19]

Inoue

[11] Patent Number: 5,726,675

[45] Date of Patent: Mar. 10, 1998

[54] IMAGE INFORMATION CONTROL APPARATUS AND DISPLAY SYSTEM

[75] Inventor: Hiroshi Inoue, Yokohama, Japan

[73] Assignee: Canon Kabushiki Kaisha, Tokyo, Japan

[21] Appl. No.: 277,575

[22] Filed: Jul. 20, 1994

Related U.S. Application Data

[62] Division of Ser. No. 161,097, Dec. 3, 1993, Pat. No. 5,357,267, which is a continuation of Ser. No. 964,556, Oct. 21, 1992, abandoned, which is a continuation of Ser. No. 721,245, Jun. 26, 1991, abandoned.

[30] Foreign Application Priority Data

Jun. 27, 1990 [JP] Japan ..... 2-171102

[51] Int. Cl.[6] ..... G09G 3/36

[52] U.S. Cl. ..... 345/97; 345/99

[58] Field of Search ..... 345/99, 97, 98, 345/87, 185, 200, 112, 115, 201, 119, 121, 127, 100; 359/56

[56] References Cited

U.S. PATENT DOCUMENTS

| | | | |
|---|---|---|---|
| 4,655,561 | 4/1987 | Kanbe et al. | 350/350 S |
| 4,693,563 | 9/1987 | Harada et al. | 340/783 |
| 5,091,723 | 2/1992 | Kanno et al. | 340/811 |
| 5,172,167 | 12/1992 | Kanno et al. | 340/811 |
| 5,345,250 | 9/1994 | Inoue et al. | 345/98 |
| 5,357,267 | 10/1994 | Inoue | 345/201 |
| 5,408,247 | 4/1995 | Enomoto et al. | 345/98 |

FOREIGN PATENT DOCUMENTS

| | | |
|---|---|---|
| 0361471 | 4/1990 | European Pat. Off. . |
| 0368117 | 5/1990 | European Pat. Off. . |

*Primary Examiner*—Regina Liang

*Attorney, Agent, or Firm*—Fitzpatrick, Cella, Harper & Scinto

[57] ABSTRACT

An image information control apparatus includes a partial write detector having at least two types of memory units for detecting and storing addresses accessed to a VRAM in units of lines in a scanning direction, thereby repeating the detection and the storage at different cycles, a circuit for performing calculations to recognize partial write information from contents of each of the memory units, memory units for storing the respective calculation results, a circuit for comparing the memory contents to determine a size relationship between partial write areas, a partial write ID signal controller for controlling a partial write ID signal on the basis of the size relationship between partial write areas and externally outputting the signal, and a circuit for, even when partial writing is being executed, forcibly interrupting the partial writing in accordance with a state of an external refresh control signal, starting refresh, and restarting the partial writing in accordance with a partial write state and a change in state of the refresh control signal.

2 Claims, 18 Drawing Sheets

CASE4 IN A HIGH AND A MIDDLE SPEED

| SAMPLING ×25 msec. | PER 25 msec. REGISTER 1 | PER 50 msec. REGISTER 2 |
|---|---|---|
| 1 | a-b | a-d |
| 2 | a-d | |
| 3 | a-b | a-d |
| 4 | a-d | |
| 5 | a-b | a-d |
| 6 | a-d | |
| 7 | a-b | a-d |
| 8 | a-d | |

IF A PARTIAL ACCESS BETWEEN a-d WASN'T FINISHED WITHIN 25 msec.

1. THE DRAWING SCROLL IS NOT DISPLAYED COMPLETELY

DOUBLE BUFFERING

CASE1 IN A HIGH SPEED

| SAMPLING | PER 25 msec. | PER 50 msec. | PER 100 msec. |
|---|---|---|---|
| ×25 msec. | REGISTER 1 | REGISTER 2 | REGISTER 3 |
| 1 | a-b, c-d | a-b, c-d, e-f | a-b, c-d, e-f, g-h |
| 2 | c-d, e-f | | |
| 3 | e-f, g-h | | |

ASSUMPTION:
DETECTING REGISTER TRANSFERS THE DATA AT 10 MHz SERIALLY

⇩

10 MHz×1Kbits(1,024LINES)=0.1 msec.

⇩

EVERY 25 msec. ALMOST ACCESSED LINES MUST BE DETECTED BECAUSE 0.1 msec. COULD BE NEGLECTED.

CASE2 IN A MIDDLE SPEED

| SAMPLING | PER 25 msec. | PER 50 msec. | PER 100 msec. |
|---|---|---|---|
| ×25 msec. | REGISTER 1 | REGISTER 2 | REGISTER 3 |
| 1 | a-b, c-d | a-b, c-d | |
| 2 | 0 | | |

CASE3 IN A HIGH AND A MIDDLE SPEED

| SAMPLING | PER 25 msec. | PER 50 msec. |
|---|---|---|
| ×25 msec. | REGISTER 1 | REGISTER 2 |
| 1 | a-b, c-d | a-h |
| 2 | a-h | |
| 3 | e-f, g-h | a-h |
| 4 | a-h | |

IF A PARTIAL ACCESS BETWEEN a-h WASN'T FINISHED WITHIN 25 msec.

1. THE DRAWING SCROLL IS NOT DISPLAYED COMPLETELY
2. THE HIGH SPEED OBJECT IS DISPLAYED IN PLURAL.

EX. c-d AND g-h COULDN'T BE DELETED.

CASE4 IN A HIGH AND A MIDDLE SPEED

| SAMPLING | PER 25 msec. | PER 50 msec. |
|---|---|---|
| ×25 msec. | REGISTER 1 | REGISTER 2 |
| 1 | a-b | a-d |
| 2 | a-d | |
| 3 | a-b | a-d |
| 4 | a-d | |
| 5 | a-b | a-d |
| 6 | a-d | |
| 7 | a-b | a-d |
| 8 | a-d | |

IF A PARTIAL ACCESS BETWEEN a-d WASN'T FINISHED WITHIN 25 msec.

1. THE DRAWING SCROLL IS NOT DISPLAYED COMPLETELY

CASE5 IN A HIGH AND A MIDDLE SPEED

| SAMPLING | PER 25 msec. | PER 50 msec. |
|---|---|---|
| X 25 msec. | REGISTER 1 | REGISTER 2 |
| 1 | a-b | c-d |
| 2 | c-d | |
| 3 | a-b | c-d |
| 4 | c-d | |
| 5 | a-b | c-d |
| 6 | c-d | |
| 7 | a-b | c-d |
| 8 | c-d | |

IF A PARTIAL ACCESS BETWEEN c-d WASN'T FINISHED WITHIN 25 msec.

1. THE DRAWING SCROLL AT 50 Hz ISN'T DISPLAYED COMPLETELY

CASE6 IN A HIGH AND A LOW SPEED

| SAMPLING X 25 msec. | PER 25 msec. REGISTER 1 | PER 50 msec. REGISTER 2 |
|---|---|---|
| 1 | a-b, c-d | a-h |
| 2 | a-h | |
| 3 | e-f, g-h | |

IF A PARTIAL ACCESS BETWEEN a-h WASN'T FINISHED WITHIN 25 msec.

1. THE DRAWING SCROLL IS NOT DISPLAYED COMPLETELY
2. THE MOVING OBJECT IN A HIGH SPEED IS DISPLAYED IN PLURAL

EX. c-d DOESN'T DISAPPEAR

CASE7: AN IMPROVED CASE3

| SAMPLING ×25 msec. | PER 25 msec. REGISTER 1 | PER 50 msec. REGISTER 2 |
|---|---|---|
| 1 | a-b, c-d | a-h |
| 2 | a-h | |
| 3 | (e-f, g-h) | (a-h) |
| 4 | (a-h) | |

THE REGISTER 2 HAS A PRIORITY GREATER THAN REGISTER 1.

a-b AND c-d FINISHES WITHIN 25 msec. BUT a-h DOESN'T FINISH a-h NEEDS 50 msec.

THUS THE MOVING IMAGES ARE DISPLAYED ONCE IN A WHILE OR IN A SKIPPED WAY.

CASE8 AN IMPROVED CASE4

| SAMPLING | PER 25 msec. | PER 50 msec. |
|---|---|---|
| ×25 msec. | REGISTER 1 | REGISTER 2 |
| 1 | a-b | (a-d) |
| 2 | (a-d) | |
| 3 | (a-b) | a-d |
| 4 | a-d | |
| 5 | (a-b) | (a-d) |
| 6 | (a-d) | |
| 7 | a-b | (a-d) |
| 8 | (a-d) | |

THE REGISTER 2 HAS A PRIORITY GREATER THAN REGISTER 1.

BUT THE PARTIAL ACCESS OF a-b AND a-d NEED 50 msec.

THE MOVING IMAGES ARE DISPLAYED ONCE IN A WHILE OR IN A SKIPPED WAY.

CASE9 AN IMPROVED CASE5

| SAMPLING ×25 msec. | PER 25 msec. REGISTER 1 | PER 50 msec. REGISTER 2 |
|---|---|---|
| 1 | a-b | c-d |
| 2 | c-d | |
| 3 | (a-b) | (c-d) |
| 4 | (c-d) | |
| 5 | a-b | c-d |
| 6 | c-d | |
| 7 | (a-b) | (c-d) |
| 8 | (c-d) | |

THE REGISTER 2 HAS A PRIORITY GREATER THAN REGISTER 1.

THE PARTIAL ACCESS OF a-b FINISHES WITHIN 25 msec. BUT c-d DOESN'T FINISH.

THEN THE MOVING IMAGES ARE DISPLAYED ONCE IN A WHILE OR SKIPPED WAY.

CASE10 AN IMPROVED CASE

| SAMPLING | PER 25 msec. | PER 50 msec. |
|---|---|---|
| ×25 msec. | REGISTER 1 | REGISTER 2 |
| 1 | a-b, c-d | a-h |
| 2 | a-h | |
| 3 | (e-f, g-h) | |

THE REGISTER 2 HAS A PRIORITY GREATER THAN REGISTER 1.

THE PARTIAL ACCESS a-b AND c-d ETC. OF THE ACCESS TO A CIRCLE FINISHES WITHIN 25 msec., BUT a-h DOESN'T FINISH. IT NEEDS 50 msec. AND THE NEXT ACCESS IS 100 msec. LATER.

THEN THE MOVING IMAGES ARE DISPLAYED SOMETIMES IN A SKIPPED WAY.

VRAM ACCESS TIME:

IN THE SCROLLING WINDOW
100 nsec./DATA × (1K × 1K) bits/8 bits=12.5 msec.

IN THE MOVING CIRCLE
100 nsec./DATA × (100 × 100) bits/8 bits=0.125 msec.

IMAGE INFORMATION CONTROL APPARATUS AND DISPLAY SYSTEM

This application is a division of application Ser. No. 08/161,097, filed Dec. 3, 1993, now U.S. Pat. No. 5,357,267, which is a continuation of abandoned application Ser. No. 07/964,556, filed Oct. 21, 1992, which is a continuation of abandoned application Ser. No. 07/721,245, filed Jun. 26, 1991.

BACKGROUND OF THE INVENTION

1. Field of the Invention

The present invention relates to a display system and, more particularly, to an image information control apparatus for use in a display system using a ferroelectric liquid crystal having a memory function.

2. Related Background Art

The screen size and the resolution of a liquid crystal display system required in a personal computer (PC) or a work station (WS) have been increased year by year, and the system is required to have compatibility with a conventional PC or WS.

Especially when a display panel using a ferroelectric liquid crystal (FLCD) imparted with a memory function is adopted in a PC or a WS, it is required to smoothly move, e.g., a mouse or a cursor to perform display. Such a moving display is realized by a partial writing system (in which only scan lines corresponding to an area to be partially rewritten are scanned) as disclosed in U.S. Pat. No. 4,655,561. In the PC or the WS, when a mouse is to be moved and displayed while a partial scroll screen is displayed (also in this case, only scan lines corresponding to the scroll screen are scanned), and especially when the mouse is to be displayed beside the scroll screen, the entire scroll screen is sometimes not displayed.

SUMMARY OF THE INVENTION

It is an object of the present invention to solve the above conventional problem and provide a liquid crystal display system and, more particularly, a ferroelectric liquid crystal display system having improved compatibility with a CRT display system.

It is another object of the present invention to provide an image information control system having improved compatibility with a CRT display system.

According to the first aspect of the present invention, there is provided an image information control apparatus and a display system using the same, the image information system comprising a partial write detector having at least two types of memory units for detecting and storing addresses accessed to a VRAM in units of lines in a scanning direction, thereby repeating the detection and the storage at different cycles, a circuit for performing calculations to recognize partial write information from contents of each of the memory units, memory units for storing the respective calculation results, a circuit for comparing the memory contents to determine a size relationship between partial write areas, a partial write ID signal controller for controlling a partial write ID signal on the basis of the size relationship between partial write areas and externally outputting the signal, and a circuit for, even when partial writing is being executed, forcibly interrupting the partial writing in accordance with a state of an external refresh control signal, starting refresh, and restarting the partial writing in accordance with a partial write state and a change in state of the refresh control signal.

According to the second aspect of the present invention, there is provided an image information control apparatus and a display system using the same, wherein the partial write information detected in units of lines by the memory units are identified as continuous line address groups in the scan line direction from the accessed address data, the number of addresses, a start line address or an end line address, or the number of lines is calculated for each group, and a total number of accessed lines is calculated.

According to the third aspect of the present invention, there is provided an image information control apparatus and a display system using the same, wherein only access to the VRAM performed during writing is rendered valid.

According to the fourth aspect of the present invention, there is provided an image information control apparatus and a display system using the same, wherein a detection period (sampling period) of the memory units for executing detection and storage in units of lines in the scan direction is shorter than a storage period thereof.

According to the fifth aspect of the present invention, there is provided an image information control apparatus and a display system using the same, wherein when the size relationship between the partial write areas obtained from the partial write information is to be determined, a detection period (sampling period) of a memory unit having partial write information of a larger area is shorter than a storage period thereof.

According to the sixth aspect of the present invention, there is provided an image information control apparatus and a display system using the same, wherein a cycle of determining the size relationship between the partial write areas obtained from the partial write information is synchronized with a cycle of the partial write detector for repeating detection and storage such that the cycles are integer multiples with respect to the different memory units, respectively.

DETAILED DESCRIPTION OF THE PREFERRED EMBODIMENTS

An apparatus and a system according to the present invention are suitable as a display using an FLCD (ferroelectric liquid crystal) imparted with a memory function and can allow use of both a partial writing method of realizing moving display such as a mouse or a cursor and a total-refresh scanning driving method.

A partial writing method used in the present invention is basically performed as follows.

① When a drawing request requires partial writing, total refresh is interrupted, and a partial write area on a screen is scanned in a non-interlace manner.

② When the partial writing is finished, the refresh is restarted.

An actual operation is not so simple as described above but requires the following recognitions:

[1] To recognize which drawing request is highest-priority partial writing

Figure 20:
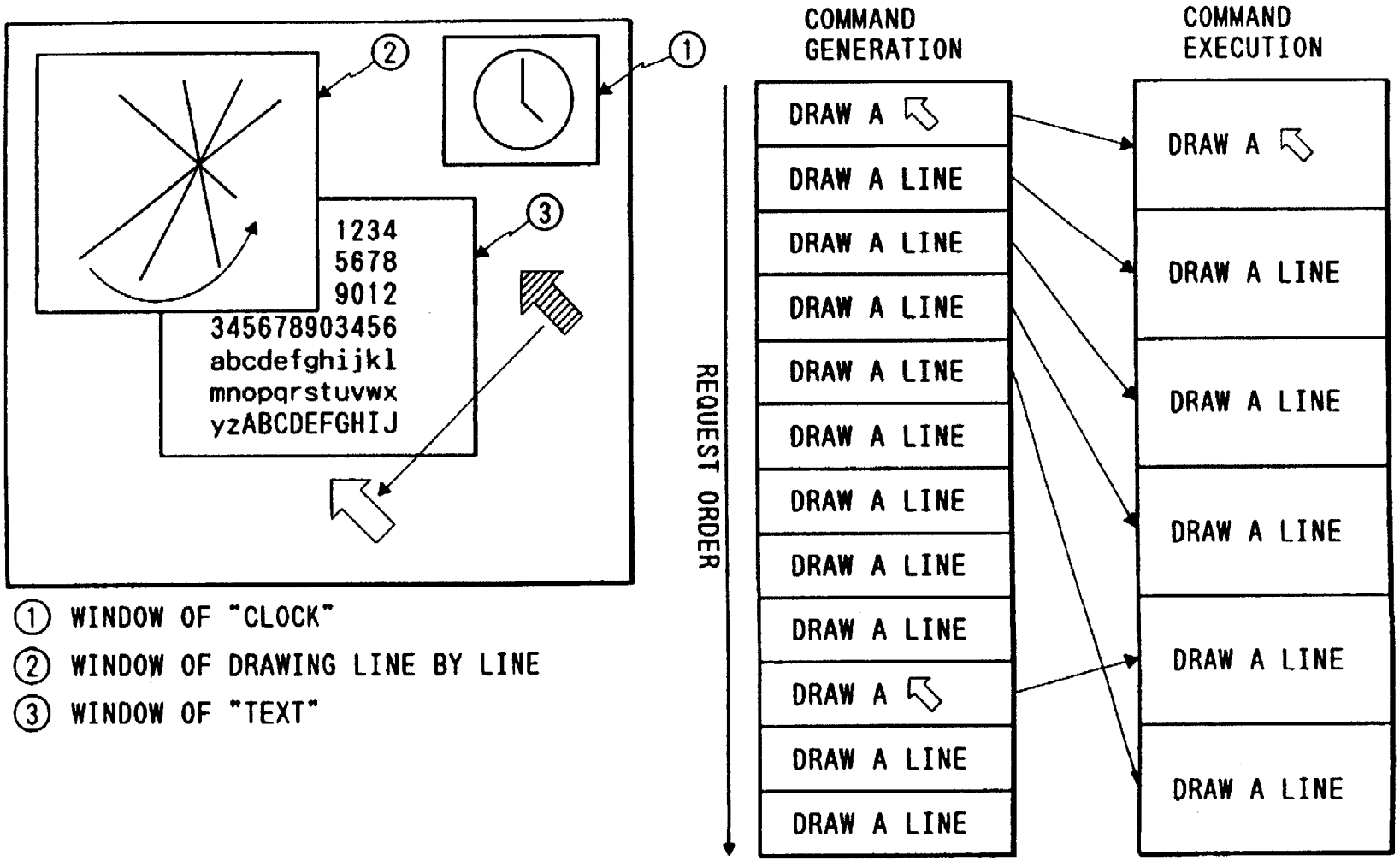
FIGS. 20 and 21 are schematic views for explaining graphic command execution.

This recognition will be described below by taking FIG. 20 as an example. FIG. 20 illustrates four events, i.e., three independent windows and a moving mouse font. A window ① displays a clock, a window ② displays a rotationally moving line, and a window 3 displays vertical scrolling of characters. The respective windows have different display speeds and display asynchronous with each other (independent events). Since a one-line access time of an FLCD remains unchanged, provided that a temperature is constant, a time (scanning time) required to perform each window display by partial writing is proportional to the size of a partial write area. If partial writing is generated in one window while partial writing is executed in another, one of the windows partial writing of which is executed prior to the other must be determined. For this reason, a priority order for partial writing operations must be predetermined when an event occurs so that the priority order is recognized to perform processing by predetermined procedures each time partial write request is generated. For example, the priority order is determined such that partial writing during scroll display is interrupted, clock display partial writing is performed, and then the interrupted partial writing is restarted, and procedures between the respective partial writing operations are determined accordingly.

[2] To have graphic scheduler for partial writing

Figure 19:
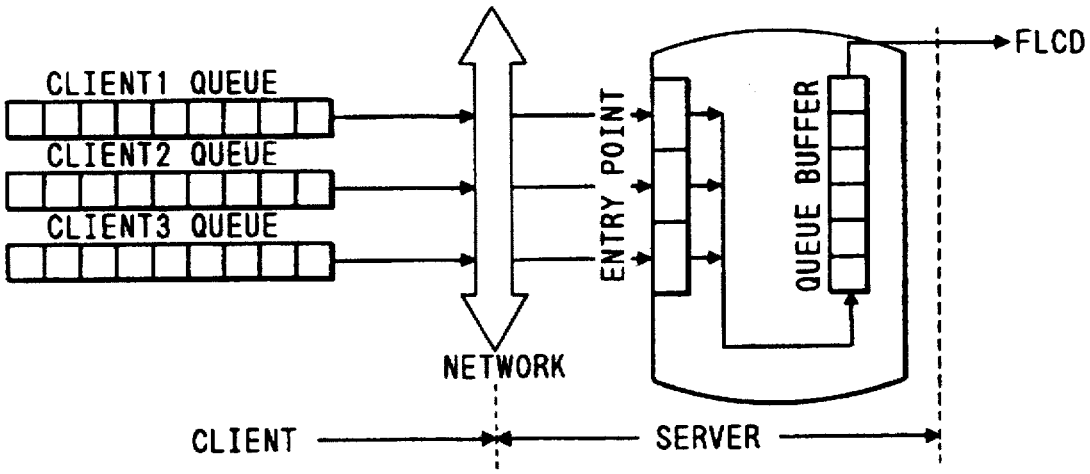
FIG. 19 is a view for explaining a scheduler in an X-window used in the present invention.

The concept of priority order is unsatisfactory in a multitask system such as a UNIX/X-Window. In such a system, several requests simultaneously access partial writing and are stored in host queues (FIG. 19). Thereafter, these requests are transferred from the respective host queues to a queue buffer of a server either via a network or internally. In this case, however, the requests are set in the buffer of the server while their drawing order to a VRAM is held. Therefore, the priority order does not work well because the requests are processed in accordance with the drawing order. For example, although "mouse" has the highest priority, if a large number of image drawing requests to the VRAM are present before the mouse request, the mouse request is not executed until the foregoing requests are finished. That is, the mouse request cannot have the highest priority order in this multitask system (FIG. 20).

Figure 21:
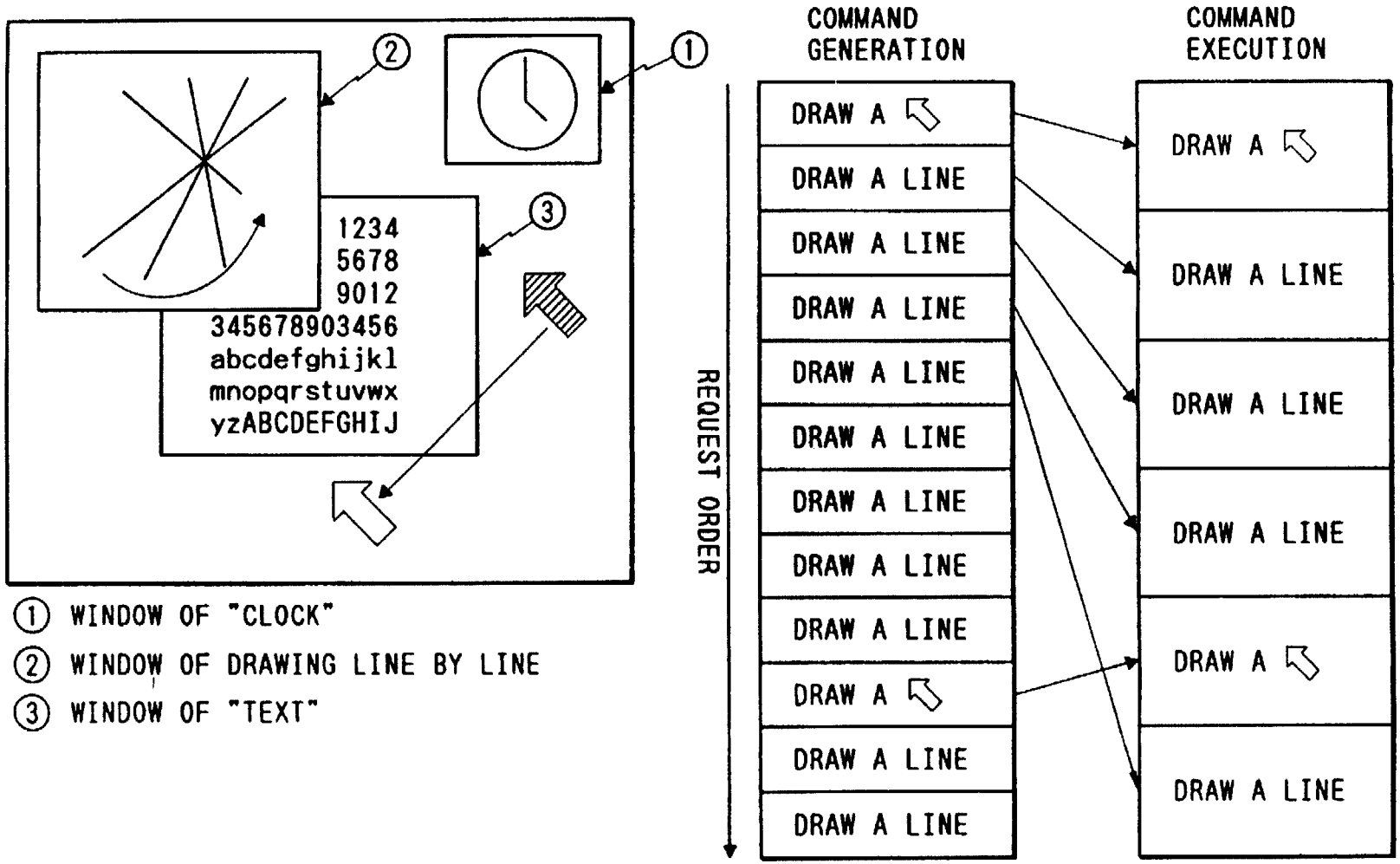

To solve the above problem, a graphic scheduler is introduced. This scheduler functions to give a proper priority order for partial writing to a request from a queue of a host (FIG. 21).

The basic concepts of the FLCD H/W interface of the present invention are as follows.

① The start, the end, and the number of a group of continuous lines accessed to a VRAM are calculated, and the data is stored in a "stack".

② Several groups are simultaneously detected for each period (different from the S/W case).

③ In the "stack", a margin for a certain time can include the above several groups.

④ Several stacks can be obtained in a priority order.

⑤ The last partial writing access has the highest priority.

Figure 1:
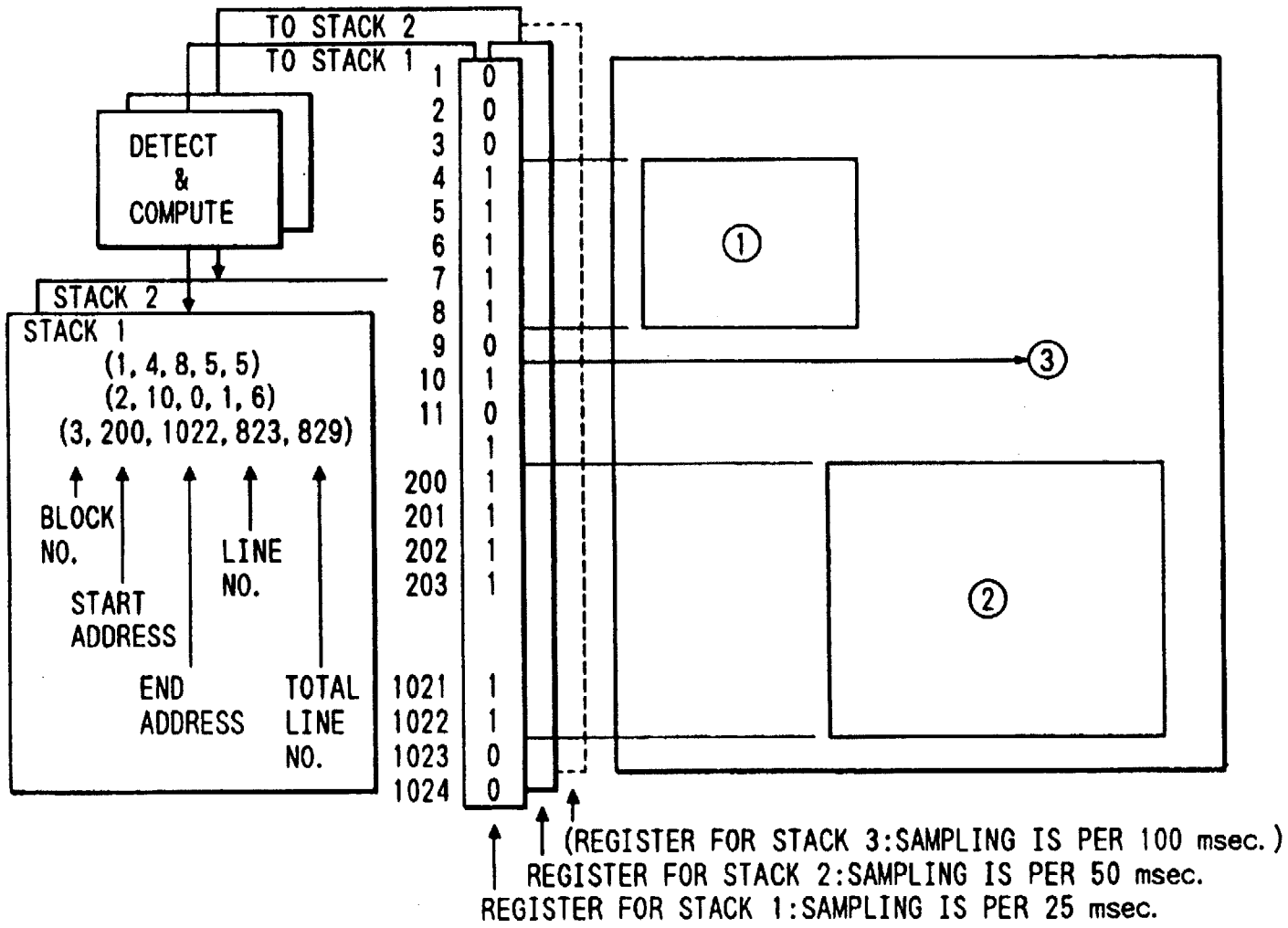
FIG. 1 is a block diagram showing an apparatus of the present invention.

FIG. 1 is a block diagram showing an apparatus of the present invention, in which a register for catching access information to a VRAM is illustrated. This information is transferred to an external circuit to count the number of partial writing operations or is transferred to another memory.

This register adopts at-random inputs and serial outputs.

Figure 2:
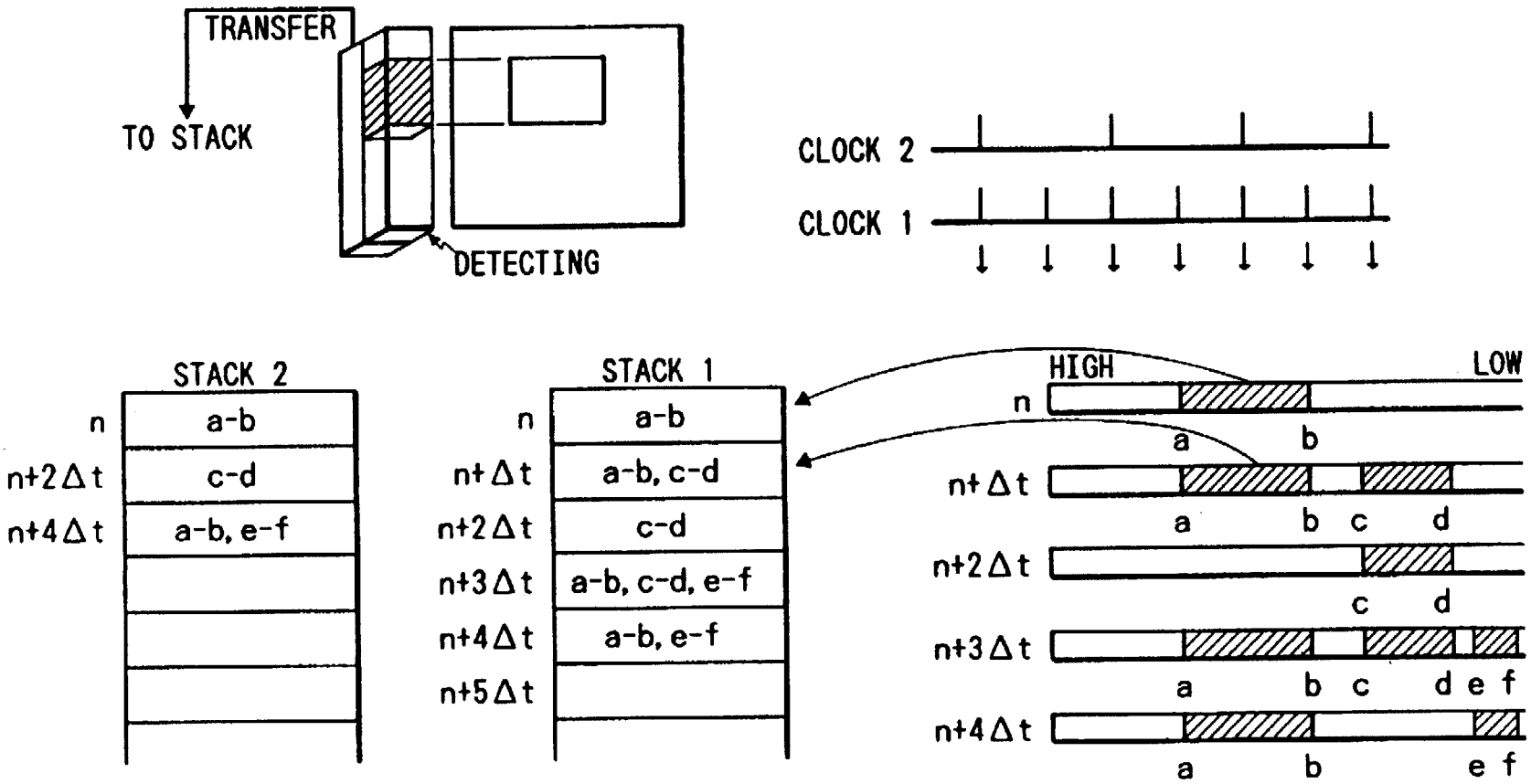
FIG. 2 is a view for explaining a multi-task used in the present invention.
Figure 7:
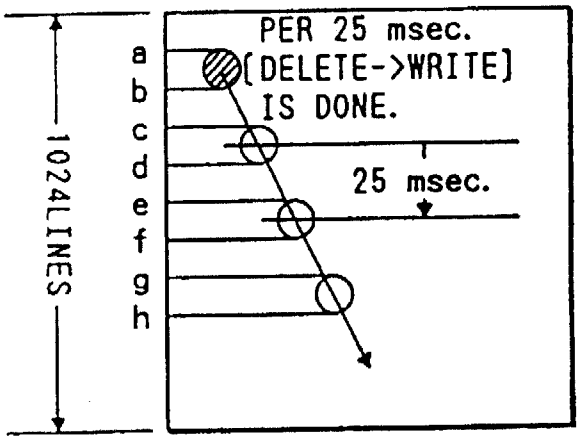
FIG. 7 is a view for explaining a case 1.

FIG. 2 shows a multistack for obtaining a priority order in the present invention. A stack 1 stores a partial write area for every t (interval of time) which is measured from a monitoring starting time n. On the other hand, a stack 2 basically stores a partial write area for every 2Δt in order to obtain a priority order. As indicated in FIG. 7, for example, letters a, b, c, d, e, and f correspond to scanning lines. Further, "CLOCK 1" in FIG. 2 corresponds to "STACK 1", with the vertical lines indicating time signals n, n+Δt, etc. at which address data is stored into STACK 1, as shown. Similarly, "CLOCK 2" corresponds to "STACK 2" and address data is stored into STACK 2 in sync with the vertical lines of CLOCK 2.

In this case, the depth level of each stack is not determined.

Figure 3:
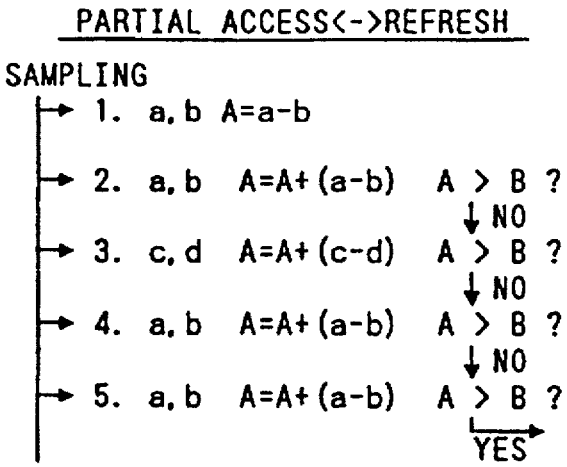
FIG. 3 is a timing chart showing timings used in the present invention.

FIG. 3 shows switching timings between partial writing and refresh in the present invention.

A value B represents the number of switching times at which a screen must be refreshed. If A, which corresponds to a cumulative number of accessed lines, exceeds B, all of partial writing operations must be interrupted to maintain a screen image by refresh.

In a current FLCD, however, it is difficult to set a fixed B.

Figure 4:
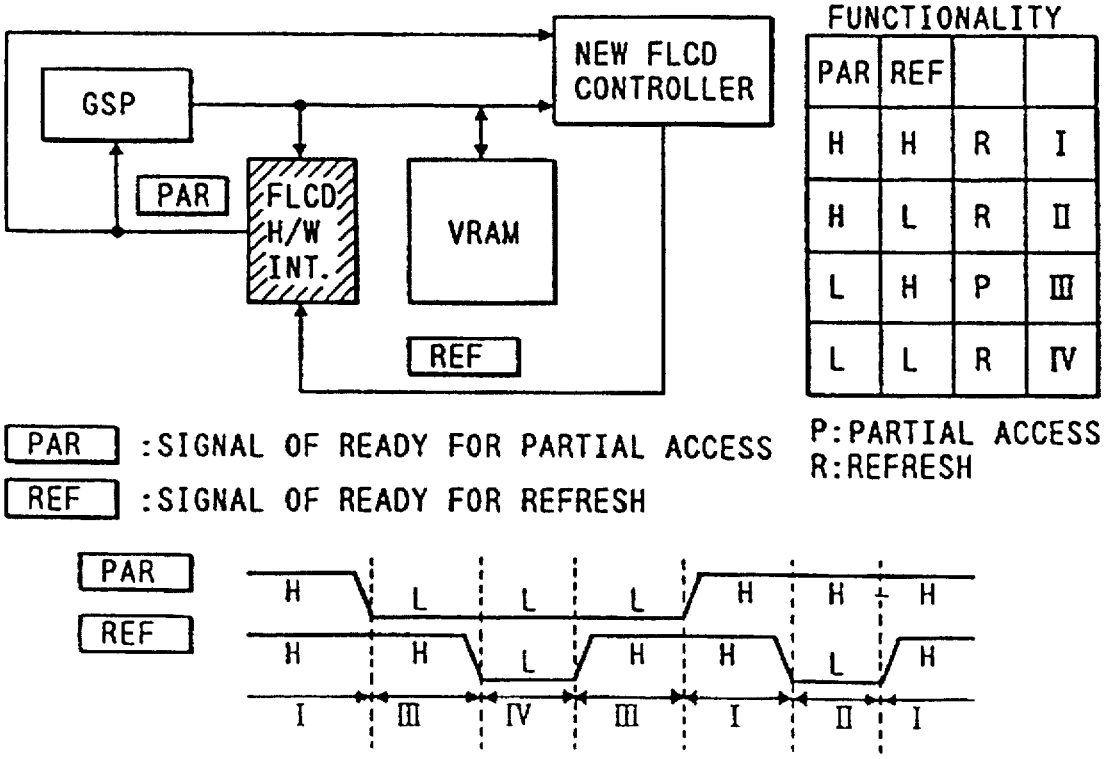
FIG. 4 is a timing chart for realizing forced refresh (LL) used in the present invention.

FIG. 4 shows two signals PAR and REF for performing switching between partial writing and refresh in the present invention. Referring to FIG. 3, a new GSP is controlling switching between partial writing and refresh.

In a GSP (tradename: available from Texas Instruments), the value "B" for an FLCD cannot be recognized, and the end of refresh in continuous partial write requests cannot be determined.

Therefore, this partial write H/W supplies the signal PAR to a new FLCD controller, and the FLCD controller supplies the signal REF to the H/W to perform refresh, independently of each other.

Figure 5:
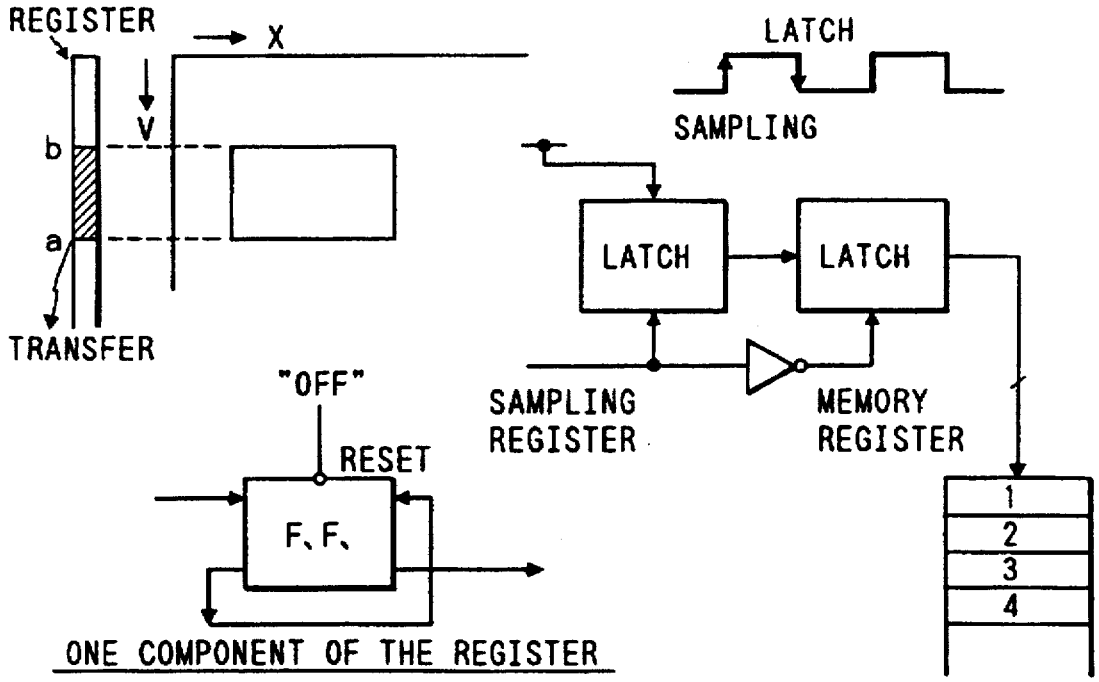
FIG. 5 is a block diagram showing hardware used in the present invention.

FIG. 5, a schematic diagram for the purpose of conceptual explanation, shows several pieces of hardware of the present invention. Double buffers are preferably used in a sampling register and a memory register.

These registers are alternately used.

Each register is constituted by a large number of F.F.s (Flip-Flops) or a static memory.

When F.F.s are used, a read register is serially reset (FIG. 5).

When a static memory is used (FIG. 6), however, another hardware must be used to serially read data, and data "0" must be overwritten at all addresses by still another hardware upon resetting.

Figure 6:
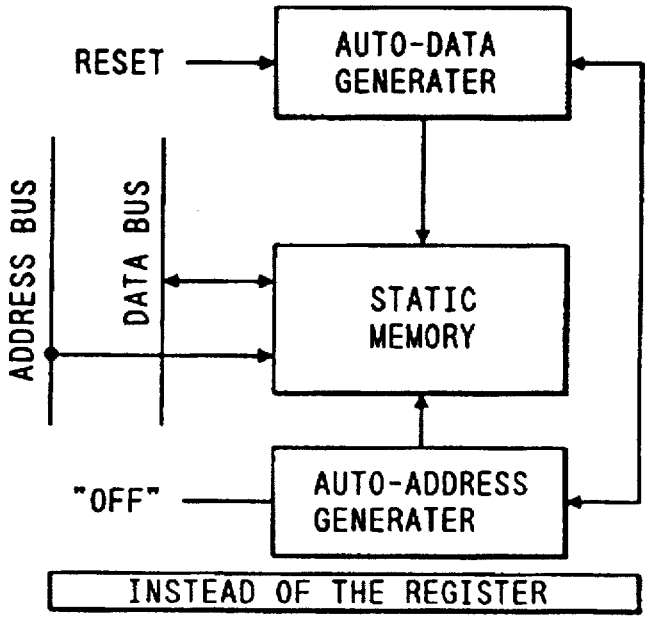
FIG. 6 is a block diagram showing a static memory.

FIG. 6 shows a static memory used in the present invention.

Premise:

An accessed line address is assigned to an address of the static memory.

Sampling:

Data "1" is set at a memory address assigned to an accessed line address.

Transfer:

When a gate is turned off, control is performed such that an address is automatically assigned to an auto-address generator.

Reset:

Upon resetting, an auto-data generator overwrites data "0" at all addresses of the memory while assigning addresses.

A case 1 shown in FIG. 7 shows a practical multi-register arrangement. In this case, only one request is generated, and processing is performed at the highest speed.

Figure 8:
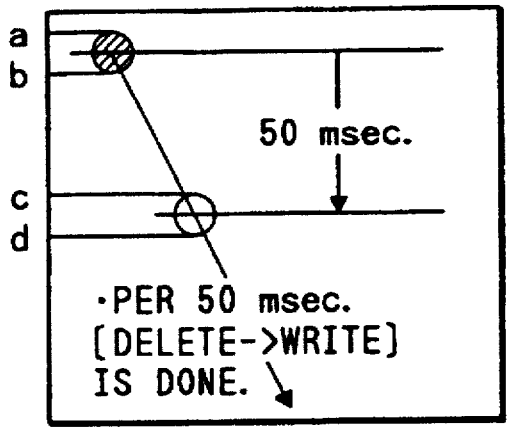
FIG. 8 is a view for explaining a case 2.

A case 2 shown in FIG. 8 shows another arrangement at a middle speed.

Figure 9:
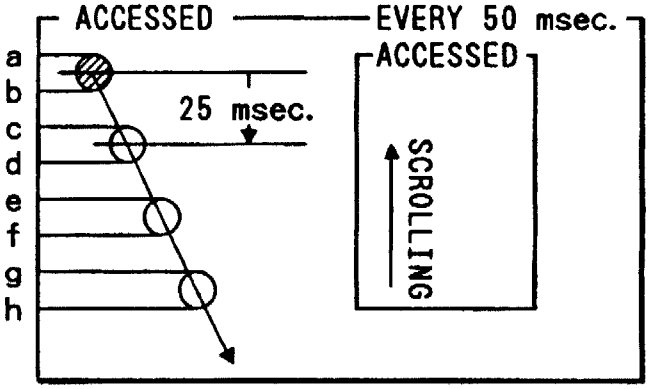
FIG. 9 is a view for explaining a case 3.

A case 3 shown in FIG. 9 shows an arrangement at high and middle speeds.

Figure 10:
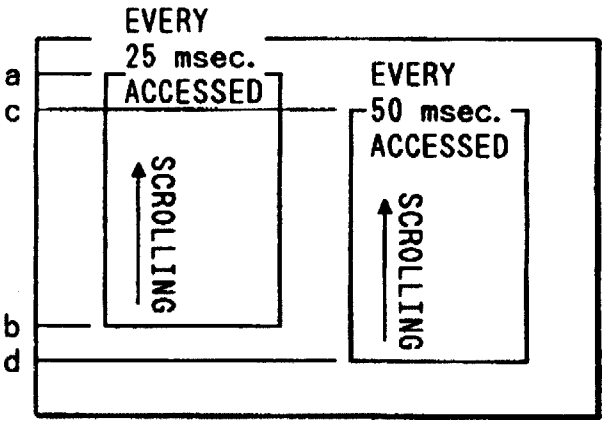
FIG. 10 is a view for explaining a case 4.

A case 4 shown in FIG. 10 shows an arrangement at a plurality of speeds. This arrangement has two windows which scroll at different speeds. This condition is strict for partial writing.

Figure 11:
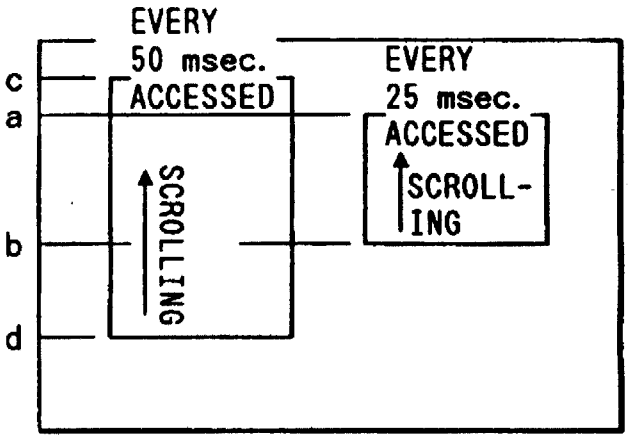
FIG. 11 is a view for explaining a case 5.

A case 5 shown in FIG. 11 is similar to the case 4 except that the sizes and positions of two windows on a screen are different from each other. This condition is also strict for partial writing.

Figure 12:
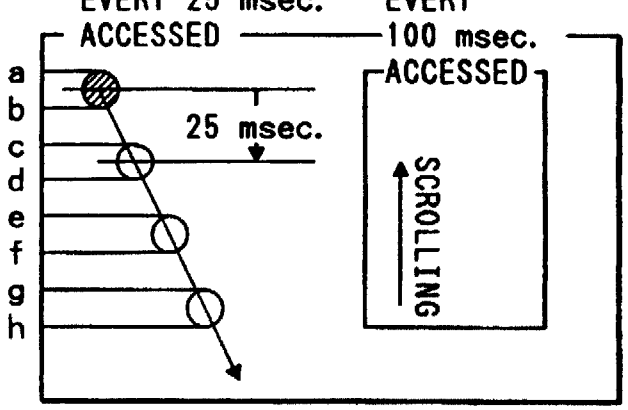
FIG. 12 is a view for explaining a case 6.

A case 6 shown in FIG. 12 is similar to the case 3 except that the scroll speed of the case 6 is different from that in the case 3. This condition is also strict for partial writing.

Figure 13:
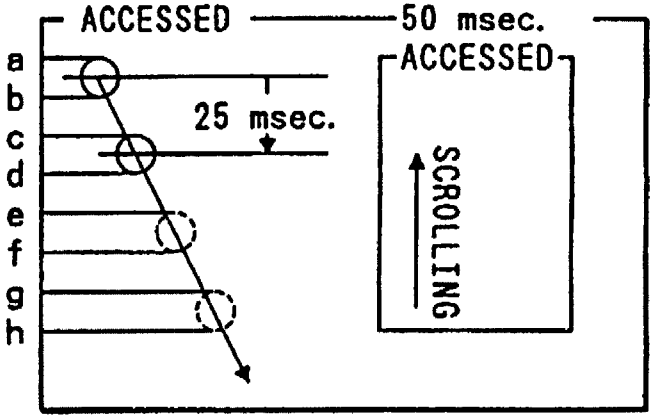
FIG. 13 is a view for explaining a case 7.

A case 7 shown in FIG. 13 is still another arrangement of the case 3, in which an improved method of obtaining a priority order is used.

Figure 14:
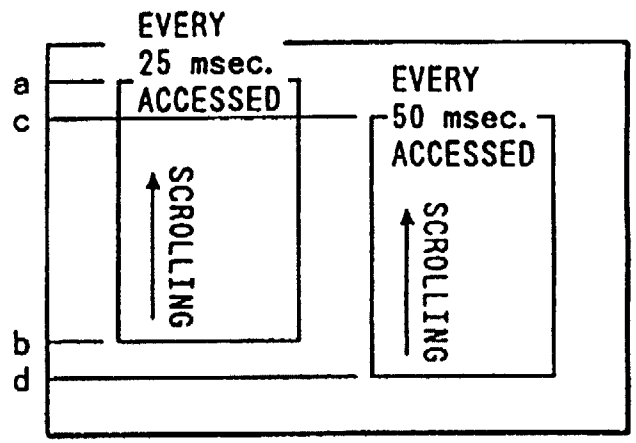
FIG. 14 is a view for explaining a case 8.

A case 8 shown in FIG. 14 is still another arrangement of the case 4. This arrangement has two windows which scroll at different speeds. Also in this case, an improved method of obtaining a priority order for partial writing is used.

Figure 15:
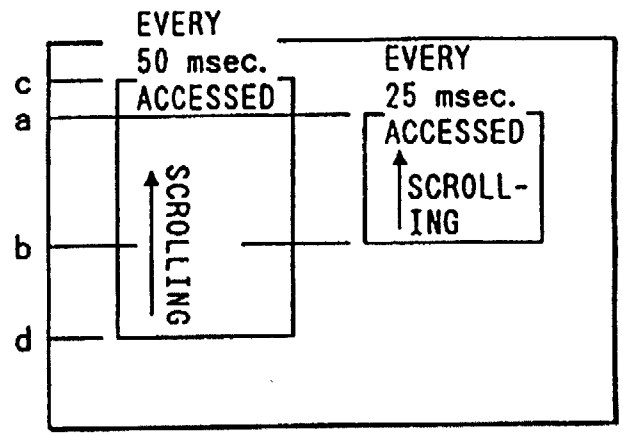
FIG. 15 is a view for explaining a case 9.

A case 9 shown in FIG. 15 shows another arrangement of the case 5, in which an improved method of obtaining a priority order is used. This case is no longer hard as compared with the foregoing partial writings.

Figure 16:
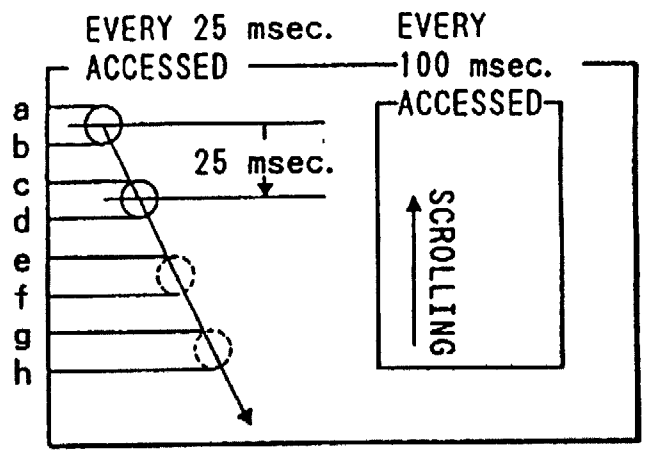
FIG. 16 is a view for explaining a case 10.

A case 10 shown in FIG. 16 shows another arrangement of the case 6, in which partial writing is no longer hard as compared with the foregoing cases. Also in this case, a timing chart shown in FIG. 17 is used.

Figure 17:
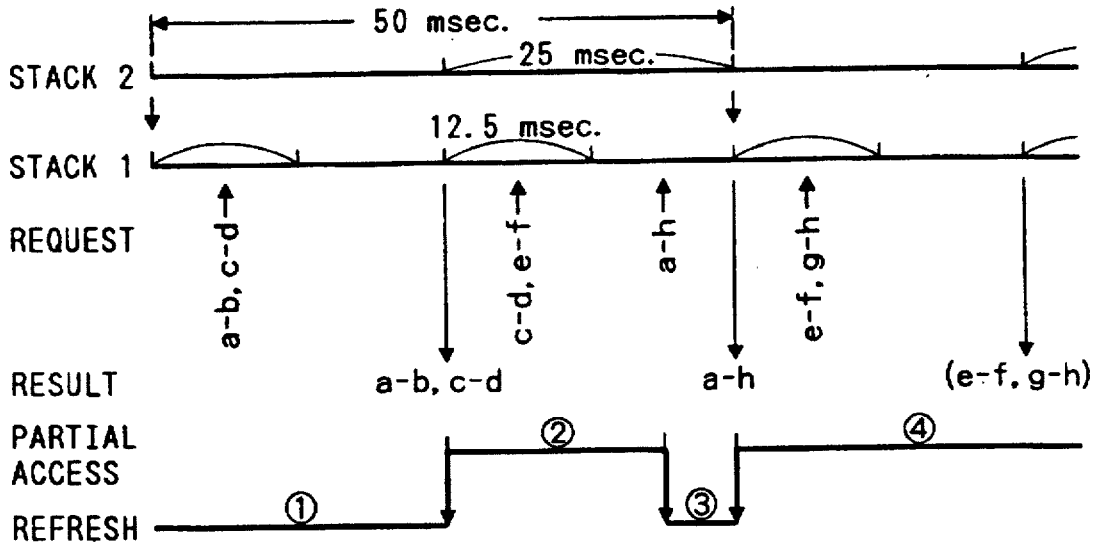
FIG. 17 is a timing chart of the present invention (according to claim 4)

FIG. 17 shows a sequence and switching of actual partial writing and refresh in the present invention according to the arrangement shown in FIG. 16.

Sampling timings and request timings with respect to stacks will be described below.

Referring to FIG. 17, actual sampling timings of stacks 1 and 2 are shifted from each other. Access requests such as a-b, c-d, e-f, and g-h accompanying movement of a circle are detected in the sampling time of the stack 1, and scroll requests are detected in the sampling time of the stack 2. Since long partial writing has a priority to short one, the final result as partial write information is obtained as shown in FIG. 17.

Therefore, actual partial writing and refresh controlled as follows.

① Refresh before partial writing is interrupted.

② Partial writing is executed for moving circles a-b and c-d.

③ Since the end timing of the a-b and c-d partial writing is before an examination timing of the next partial writing, the stack 1 is in a data indefinite state, and the stack 2 is sampling. Therefore, refresh is executed.

④ When partial write data are determined, the respective stack data are compared with each other, and partial writing of sampling data of the stack 2, a-h, and a scroll request is executed.

Figure 18:
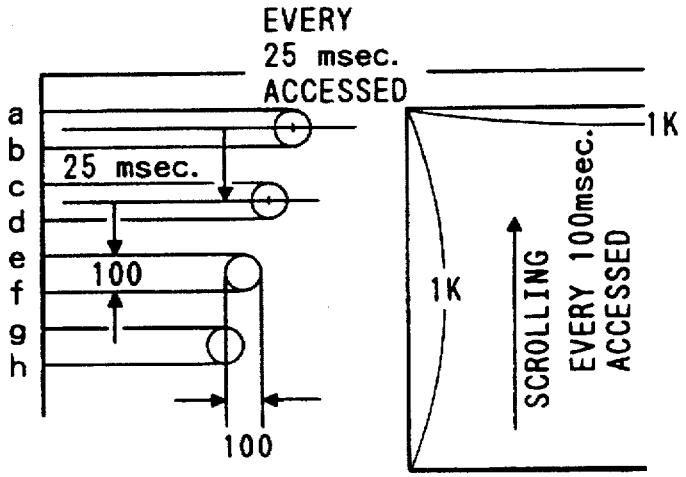
FIG. 18 is a view for explaining a sampling H/W used in the present invention.

FIG. 18 shows a practical example for explaining an actual sampling H/W in an FLCD interface according to the timing chart shown FIG. 17.

Referring to FIG. 18, a scrolling image and a moving circle are present on a screen.

Assumption:

A VRAM access time per bit is 100 nsec.

A VRAM is constituted by 1 M×8 bits. The size of the circle is 100×100 bits, and the scroll size is 1 K×1 K bits. Therefore, times required for the moving circle and the scrolling window are 0.125 msec. and 12.5 msec., respectively.

The circle moves every 25 msec., and scrolling is performed every 100 msec.

Access to VRAM

Types of access to the VRAM are actually READ access and WRITE access. Strictly speaking, the WRITE access is actually required in terms of partial write control.

Figure 22:
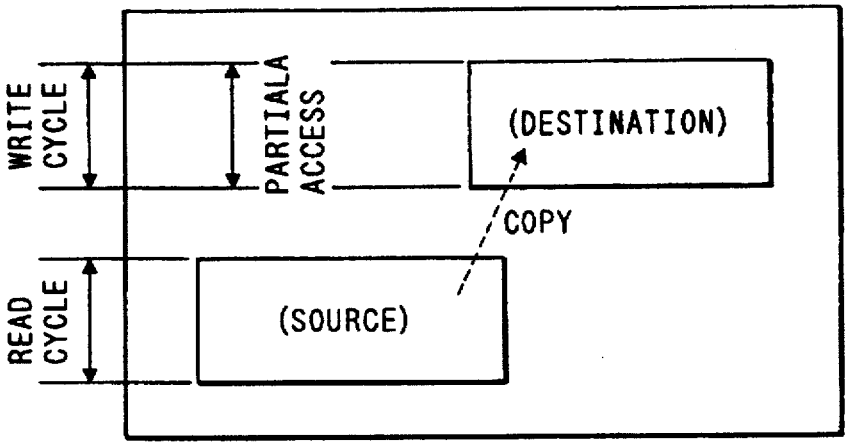
FIG. 22 is a view of explaining VRAM access.

FIG. 22 shows an example of copying one window to the other. In this case, a copy source window is accessed to the VRAM in a READ CYCLE, and a copy destination window is accessed in a WRITE CYCLE. Actually, partial writing is started at only the copy destination and need not be performed at the copy source.

Partial writing is always performed after the access to the VRAM in the WRITE CYCLE and need not be performed in the READ CYCLE.

If both the READ and WRITE CYCLEs are used to detect access to the VRAM, time consumption for partial writing is doubled.

[2] Scheduler

As described above, the FLCD requires a scheduler under the multitask. In a hardware interface, long partial writing has a priority, or partial write data latched at the start timing of partial writing has a priority. In addition, until one partial writing cycle is finished, another partial writing cycle is not accepted. Therefore, an order of actually generated partial write requests is uniformed during the sampling period, and partial writing operations are simultaneously executed thereafter. For this reason, a priority order of each event is determined based on a size relationship between physical partial write areas by the hardware of item [1] above, and simultaneous partial writing operations are superposed within a certain period. Therefore, scheduling of the partial write request order at this timing is assumed to be completed.

As described above, the FLCD partial writing mainly requires two items, and these two items must have the same function in the hardware interface.

The item [1] is related to a priority order, and the item [2] is related to a scheduler. (The scheduler of item [2] above has no clear arrangement but is included in the hardware of item [1] and has a function different therefrom.)

As shown in FIGS. 1, 2, 3, and 5 and the basic concept, allocation of priority orders can be obtained by an H/W using the following procedures.

① At least two specific registers are provided.

② With respect to the scan direction, y line accessed to the VRAM is detected by the registers during the respective sampling periods (by using the double buffer technique as shown in FIG. 5). The sampling period is, e.g., a maximum of 25 msec.

③ Obtained data are serially transferred to an external circuit. A transfer clock is, e.g., 10 MHz (FIG. 2).

④ The external circuit checks whether the accessed y lines are only one line or a block having start and end addresses, and calculates the number of accessed lines/blocks or the total number of accessed lines. That is, the serial data is converted into parallel data, and the accessed continuous block in the registers is obtained in an external memory called stacks.

⑤ These detected data for partial writing are stored in the respective stacks at different sampling periods, e.g., 25 msec. and 50 msec. A stack having two or more sampling periods can be made (FIGS. 3 and 4).

⑥ If an image is to be held on a screen while partial writing is continued for a long time period or permanently, the total number of accessed lines must be monitored. However, it is difficult to set B fixed through hardware for the following two reasons.

B is a limiting value with respect to the total number of accessed lines to be monitored. B is probably smaller than the total number of scan lines because if B exceeds the total number, an access time for this partial writing exceeds a frame period. In other words, non-interlace is caused by partial writing over the frame period. For this reason, flicker is easily caused.

In addition, since the frame period changes due to a temperature dependency of the FLCD, B changes in accordance with temperatures. Therefore, no fixed value B can be set.

The other reason, which is important, is that a refresh stop timing must be known during partial writing. This stop timing is also variable due to the temperature dependency of the FLCD. To solve these problems, two control signals PAR and REF are used in the FLCD H/W interface.

There are two ideas of allocating priority orders. The cases 1 to 6 show several examples using an invention that the fastest partial writing has the first priority order.

In this description, assume that the pixel size of the FLCD is 1,024 (vertical)×1,280 (horizontal) and the frame frequency (refresh rate) at an ordinary use temperature is 20 Hz.

The plurality of registers described above are designed to distinguish priority orders. However, a care must be paid to the cases 3 to 6 for allocating priority orders well.

The cases 3 to 6 suggest that very strict limitations are necessary.

A register 1 detects the fastest movement of, e.g., every 25 msec. (=40 Hz).

A register 2 detects the second fastest movement of, e.g., every 50 msec. (=20 Hz).

A register 3, if present, detects the third fastest movement of, e.g., every 100 msec. (=10 Hz). Although it is assumed that a register 4 detects a movement of every 200 msec. or more, the register 4 is meaningless because refresh of the FLCD is performed at 20 Hz or less (50 msec. or more). The register 3 is unnecessary for the same reason.

Thereafter, the data move to the respective stacks as shown in FIG. 2. In the cases 1 and 2, the respective movements are detected and displayed well because there is only one movement in each case.

However, care must be exercised when different movements are simultaneously present as in each of the cases 3 to 6. If the fastest register for partial writing has the highest priority order as described in each drawing operation, it is understood that a very strict limitation is present to complete a plurality of partial writing operations. That is, the frame frequency of the FLCD must be higher than the highest sampling frequency, i.e., 25 msec. (=40 Hz), and this is impossible in this FLCD.

An opposite assumption with respect to priority order allocation must be made (cases 7 to 10). That is:

The priority order is "stack 2>stack 1". In other words, until the longest partial writing with respect to an FLCD panel is finished, the stack 1 does not affect the partial writing. This will be described in more detail below. (The cases 1 and 2 are not affected by this new assumption because only one request is present in each case).

In the case 7, on the basis of the new partial writing priority order allocation assumption, the fastest moving object is not continuously displayed but sometimes displayed or skipped and displayed. In the case 8, the movement of the stack 1 is skipped as in the case 7.

In the case 9, the same result as in the case 8 is obtained.

In the case 10, the same result as in the case 7 is obtained.

The operation is performed well in all cases (cases 7 to 10) regardless of the speed of the FLCD because until the longest partial writing is finished, another partial writing is interlaced. Therefore, the conventional problem cannot arise.

The last invention about priority order allocation is an actual execution manner. In the above description, it is assumed that partial write data is instantaneously detected by the register and stored during the sampling period. In actual processing, however, a certain period must be consumed in sampling. In addition, the FLCD must have a scheduler for requests simultaneously generated especially under the multitask. Therefore, the H/W FLCD interface operates, for example, as shown in FIG. 17.

Referring to FIG. 17, an actual sampling time of the stack 1 is 12.5 msec., and that of the stack 2 is 25 msec., i.e., twice that of the stack 1. During these periods, it is assumed that the gates to the detectors (registers) are "ON". Each register detects and stores an accessed line address. The sampling interval of the stack 1 is 25 msec., and that of the stack 2 is 50 msec.

As parameters in FIG. 17, FIG. 18 and the case 10 described above are used.

Two images are present on a screen: one is an image of a circle moving at a high speed; and the other, a scrolling window. The circle moves every 25 msec. (=40 Hz), and the scroll speed is every 100 msec. (=10 Hz).

The access time of a VRAM per bit is 100 nsec/bit (this speed is considerably higher than other speeds). In this case, eight bits can be simultaneously accessed.

In a scrolling window, one scroll full-screen access time is:

$$100\ \text{nsec.}\times(1\ \text{K}\times 1\ \text{K})\ \text{bits}/8\ \text{bits}$$
$$=12.5\ \text{msec.}\ll 100\ \text{msec.}$$

Therefore, one-screen access of the window can be completely detected within the sampling time of 25 msec. of the stack 2. In addition, since the scroll speed is 100 msec. while the sampling interval is 50 msec., partial writing of one scroll screen can be started after the detection.

On the other hand, since two accesses of delete and write are performed as a unit for the circle to display one movement thereof:

$$100\ \text{nsec.} \times (100 \times 100)\ \text{bits}/8\ \text{bits.} = 0.125\ \text{msec.} \quad 1\ \text{access}$$

$$0.125\ \text{msec.} \times 2 = 0.25\ \text{msec.} << 25\ \text{msec.} \quad 1\ \text{moving}$$

Therefore, one moving display access cycle can be completely detected within the sampling time of 12.5 msec. of the stack 1. In addition, since the sampling interval is 25 msec., at least one moving display partial writing cycle can be started for a circle having a moving speed of 25 msec.

A case in which scrolling and a circle are simultaneously present will be described below. This case corresponds to the case 10.

In the description of FIG. 17, when partial writing of the stack 2 for larger partial writing is to be started, a scrolling window includes image information of a circle present on the screen. Partial writing of the circle moving during scrolling is displayed in accordance with information from the stack 1.

If the end of partial writing comes before comparison between the stacks and both the stacks have indefinite sampling data or are executing sampling, refresh is performed until the next comparison time (=③).

When the next partial write time comes, partial writing is started by interrupting the refresh.

If no partial write data is present, the refresh is, of course, continued until the next partial writing is detected.

According to the present invention, compatibility with respect to a CRT display system is improved by simultaneously displaying partial scrolling and a mouse movement.

What is claimed is:

1. A display apparatus, comprising:

a display panel with a memory function having a driving control means; and an image information control means for performing partial writing to a VRAM, wherein rewrites in at least two windows are executed by non-interlace scannings for only scanning lines corresponding to the windows, rewrite datas in the two windows are independently sampled and stocked, and when the two samplings have different frequencies, the rewrite based on rewrite data of one window with a later sampling frequency is preferentially executed, while the rewrite based on rewrite data of the other window with a faster sampling frequency is skipped during the preferentially executed rewrite.

2. A display apparatus according to claim 1, wherein said display panel is a panel having ferroelectric liquid crystal elements.

* * * * *

UNITED STATES PATENT AND TRADEMARK OFFICE

CERTIFICATE OF CORRECTION

PATENT NO. : 5,726,675

DATED : March 10, 1998

INVENTOR(S) : Inoue

It is certified that error appears in the above-identified patent and that said Letters Patent is hereby corrected as shown below:

COLUMN 4:

Line 26, "every t" should read --every Δt--.

COLUMN 7:

Line 18, "stacks." should read --"stacks "--.
Line 20, "stacks" should read --"stacks"--.
Line 66, "stacks" should read --"stacks"--.

Signed and Sealed this

Third Day of November, 1998

*Attest:*

*Attesting Officer*

BRUCE LEHMAN

*Commissioner of Patents and Trademarks*